US006651449B2

(12) United States Patent
Heims et al.

(10) Patent No.: US 6,651,449 B2
(45) Date of Patent: Nov. 25, 2003

(54) WATER BOTTLE FILL BUTTON FOR REFRIGERATORS

(75) Inventors: Doug A. Heims, Cedar Rapids, IA (US); Tim Bergmann, Cedar Rapids, IA (US); David A. Stauffer, Belle Plaine, IA (US); Michael J. Eveland, Cedar Rapids, IA (US); Todd E. Kniffen, Williamsburg, IA (US); Ravi Kumar Sawhney, Calabasas, CA (US); John Frank Zinni, Capistrano Beach, CA (US); Timothy Mark Nugent, Venice, CA (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/195,653

(22) Filed: Jul. 15, 2002

(65) Prior Publication Data

US 2003/0019236 A1 Jan. 30, 2003

Related U.S. Application Data

(60) Provisional application No. 60/305,759, filed on Jul. 16, 2001.

(51) Int. Cl.[7] ..... F25C 5/18; F25D 23/12

(52) U.S. Cl. ..... 62/98; 62/338; 62/389; 222/146.6

(58) Field of Search ..... 62/389, 390, 338, 62/344, 98; 222/108, 146.6, 192

(56) References Cited

U.S. PATENT DOCUMENTS

| | | | | |
|---|---|---|---|---|
| 2,512,395 A | | 6/1950 | Sundberg | |
| 3,429,140 A | * | 2/1969 | White | 62/339 |
| 3,851,939 A | | 12/1974 | Benasutti et al. | |
| 4,739,629 A | * | 4/1988 | True | 62/338 |
| 5,112,477 A | | 5/1992 | Hamlin | |
| 5,269,154 A | * | 12/1993 | Schmidt | 62/275 |
| 5,297,400 A | | 3/1994 | Benton et al. | |
| 5,490,547 A | | 2/1996 | Abadi et al. | |
| 5,956,967 A | | 9/1999 | Kim | |

FOREIGN PATENT DOCUMENTS

JP 404363571 A 12/1992

* cited by examiner

*Primary Examiner*—William E. Tapolcai
(74) *Attorney, Agent, or Firm*—McKee, Voorhees & Sease, P.L.C.

(57) ABSTRACT

An ice and water dispenser for refrigerator doors is provided that includes an ice dispensing actuator pad that causes dispenser to deliver ice when activated. The dispenser also includes a water dispensing lever that causes the dispenser to deliver water when pushed. The ice and water dispenser includes a control panel that allows the user to control the dispensing operation, such as whether to dispense crushed or cube ice. Because of the arrangement of the ice and water dispensing actuators, the user can insert a glass into the dispensing cavity and dispense both ice and water simultaneously. Further, because of the arrangement of the ice and water dispensing actuators, the user can fill oversize cups, water bottles, or pitchers without having to awkwardly reach around the cup to manually activate the water dispensing lever or push the ice dispensing actuator.

12 Claims, 3 Drawing Sheets

WATER BOTTLE FILL BUTTON FOR REFRIGERATORS

CROSS-REFERENCE TO RELATED APPLICATIONS

This invention claims priority to the U.S. provisional application Ser. No. 60/305,759 entitled "Water Bottle Fill Button for Refrigerators" filed on Jul. 16, 2001.

BACKGROUND OF THE INVENTION

The present invention relates generally to refrigerators and more particularly to ice and water dispensers located on the outer surfaces of the doors of refrigerators.

As is well known, a refrigerator many times may be provided with an ice dispenser and a water dispenser. Such dispensers typically are mounted in an outer surface of a refrigerator door. In a side-by-side refrigerator, the dispenser generally is located in the freezer compartment door. Each dispenser typically has a lever, actuator button, or actuator pad disposed at the rearmost surface of the housing into which a glass or cup could be inserted for filling. The glass would be pressed against the actuator button, pad, or lever, thus activating the dispensing of water, or ice cubes, as desired.

Typically, the user can only dispense water or ice at separate times. U.S. Pat. No. 5,956,967 to Kim discloses a dispenser where the water and ice are dispensed by actuating the same lever, button or pad. The user first must select either water, ice, or even crushed ice before pressing the glass up against the actuator lever, button or pad. The user can only dispense one item at a time and must remove the glass from the actuator before selecting another item to dispense. After selecting another item to dispense, the user again must press the glass up against the actuator lever, button or pad. Dispensing both water and ice requires the user to reposition the glass multiple times while operating multiple buttons. This process consumes time and may be awkward, particularly with an oversized cup, water bottle, or pitcher.

Still, other dispensers utilize separate levers for dispensing water and ice. U.S. Pat. No. 5,112,477 to Hamlin and U.S. Pat. No. 3,851,939 to Benasutti disclose dispensers that have separate actuators for dispensing water and ice. The user has to press the glass up against one lever, pad or button to dispense only ice. Afterward, the user has to re-position the glass in order to press it up against a separate lever, pad or button to dispense only water. This process also consumes time and is particularly awkward with larger cups. With oversize cups, water bottles, or pitchers, the user may not be able to position the bottle properly within the dispensing cavity. As a result, the user may not be able to properly actuate the ice or water levers and may have to hold the oversize cup with one hand while manually activating the dispenser levers by reaching around the back of the cup with the other hand.

Accordingly, a primary objective of the present invention is the provision of an ice and water dispenser that allows for the simultaneous dispensing of both ice and water.

Another objective of the present invention is the provision of an ice and water dispenser whereby the user can dispense ice and water without having to reposition the glass, water bottle, or pitcher.

A further objective of the present invention is the provision of an ice and water dispenser that can fill oversize cups, water bottles, or pitchers with both ice and water without requiring the user to reach around the back of the oversize cup to activate the dispenser actuators.

These and other objectives will become apparent from the following specification and claims.

BRIEF SUMMARY OF THE INVENTION

The present invention is directed towards a refrigerator ice and water dispenser mounted on the outer surface of a refrigerator door. The apparatus generally comprises a dispensing cavity that includes an ice dispenser actuator pad and a water dispenser lever.

By pressing a glass or other container up against the ice dispenser actuator, the user triggers an ice dispensing switch which allows for ice to be dispensed into the glass. The ice dispenser actuator is centrally located within the dispenser cavity to accommodate oversize cups, water bottles or pitchers as well.

By manually pressing the water dispensing lever, the user triggers a water dispensing switch which allows for water to be dispensed into the glass. The water dispensing lever is located above the dispensing cavity so as not to be blocked by an oversize cup, water bottle, pitcher or other container. Further, the water dispensing lever may be depressed at the same time as the ice dispensing actuator, allowing for the simultaneous delivery of both ice and water into the glass.

A control panel is provided that controls the dispensing operation. Through interacting with the control panel, the user can select various options, such as whether to dispense cube or crushed ice.

DETAILED DESCRIPTION OF THE INVENTION

The present invention will be described as it applies to its preferred embodiment. It is not intended that the present invention be limited to the preferred embodiment. It is intended that the invention cover all modifications and alternatives that may be included within the spirit and scope of the invention.

Figure 1:
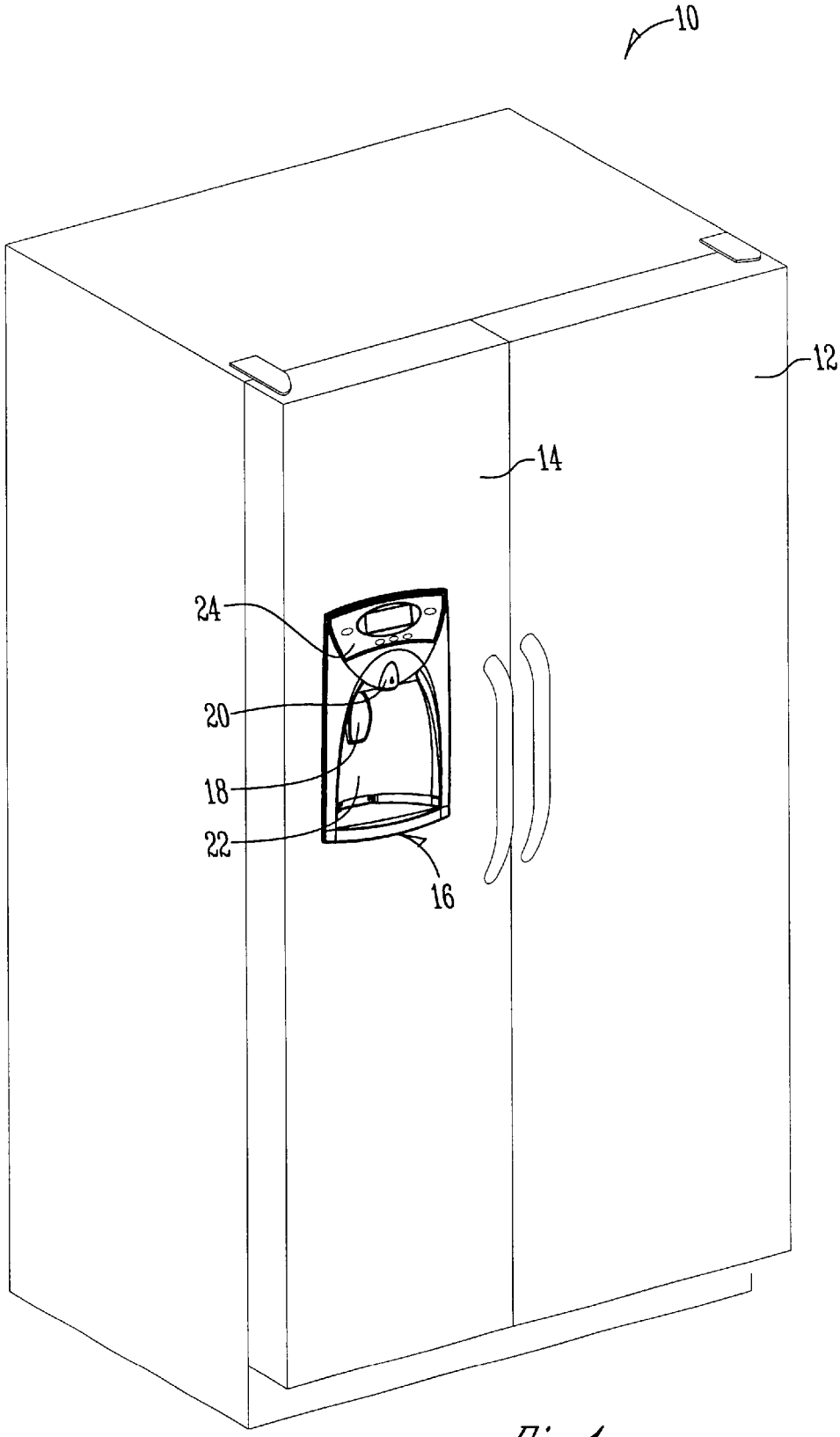
FIG. 1 is a perspective view of a refrigerator equipped with the present invention.

With reference to FIG. 1, a conventional refrigerator 10 is shown, refrigerator 10 being of the side-by-side design, wherein refrigerator 10 has a refrigeration compartment sealed by a refrigerator compartment door 12 and a freezer compartment sealed by a freezer compartment door 14. Freezer door 14 may be provided with an ice and water dispenser 16, generally including a housing 17 wherein an ice dispensing actuator member 18 and a water dispensing lever 20 are mounted within the dispenser cavity 22. Dispenser 16 may be provided with a suitable control panel 24, through which the user may select the type of ice to be dispensed, such as ice cubes or crushed ice. It should be noted that dispenser 16 could also be found in other types of refrigerators, other than those of side-by-side construction, and thus the dispenser of the present invention, as will be hereinafter described in greater detail, can similarly be used in both refrigerators of side-by-side design, as well as other designs.

Figure 2:
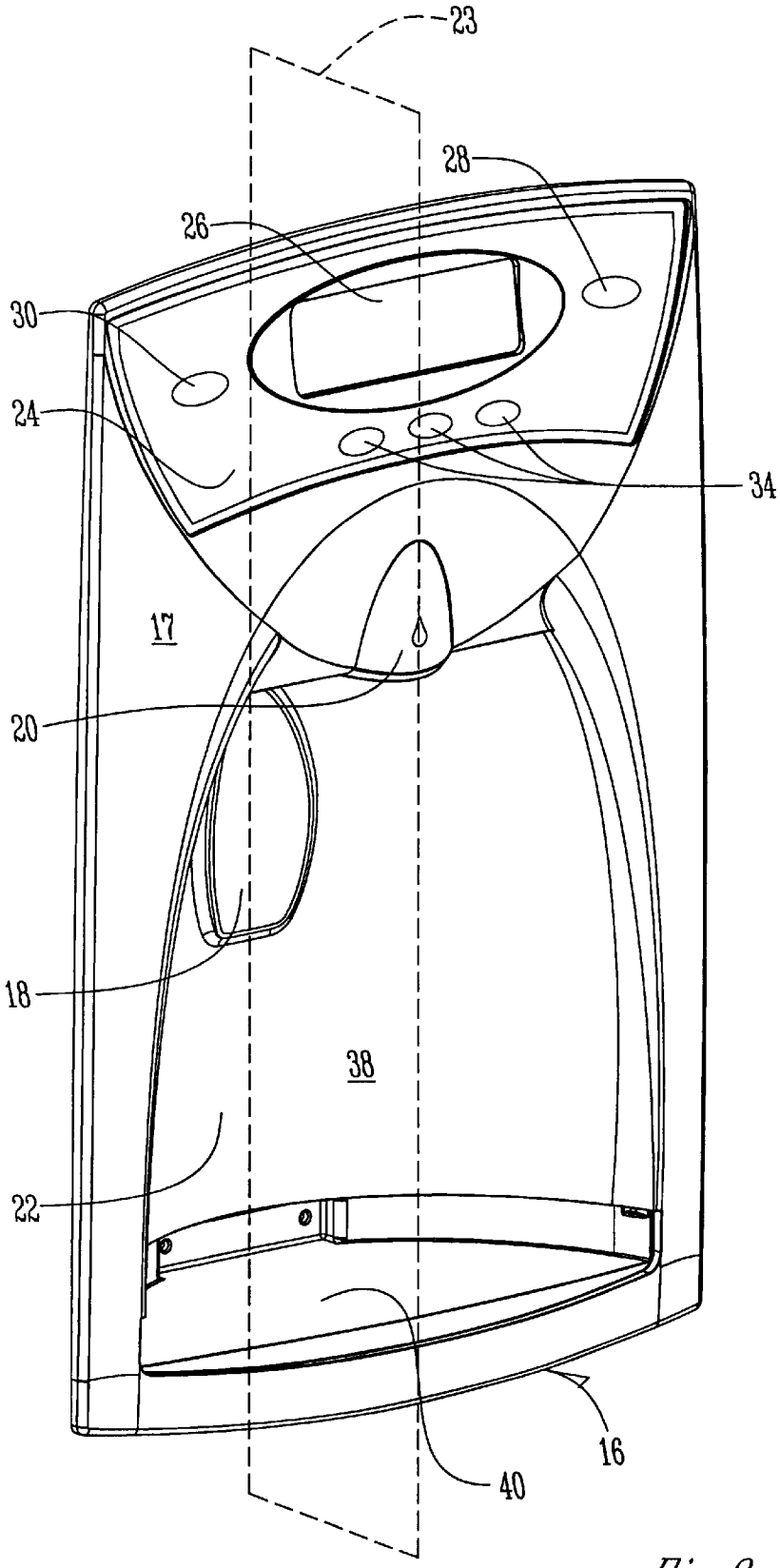
FIG. 2 is a front perspective view of the present invention.

With reference to FIG. 2, the front side of the ice and water dispenser 16 of the present invention is illustrated.

Dispenser 16 may be mounted in any refrigerator, such as refrigerator 10 shown in FIG. 1. The dispenser 16 includes a dispenser cavity 22. Mounted on the rear surface 38 of the dispenser cavity 22 is the ice dispensing actuator 18. Mounted to the top of the dispenser cavity 22 is the water dispensing lever 20. When viewed from the front as shown in FIG. 2, it can be seen that the ice dispensing actuator 18 and the water or liquid dispensing actuator/lever 22 can dispense ice and liquid respectively in a substantially common vertical plane 23. A tray 40 sits on the bottom ledge of the dispenser cavity 22 to catch excess liquid or ice.

A control panel 24 includes a liquid crystal display 26. A menu button 30 manipulates the data displayed on the liquid crystal display 26, and a plurality of selection buttons 34 allows the user to select various options, such as the type of ice to be dispensed. A message button 28 allows the user to access messages displayed on the liquid crystal display 26 when the message indicator light 32 is illuminated. A light sensor 36 detects the available light in the room and adjusts the liquid crystal display 26 accordingly such that the display 26 is still visible even at night. To dispense ice or water, the user inserts a glass into the dispenser cavity 22. If the user desires to dispense ice, the user presses the glass up against the ice dispenser actuator pad 18. Depending upon the settings of the control panel 24, the ice dispenser will either deliver cube or crushed ice. If the user desires to dispense water, the user holds the glass with one hand while pressing the water dispenser lever 20 with the other hand. It is important to note that the user may dispense both ice and water simultaneously by pressing the water dispenser lever 20 while pressing the glass against the ice dispenser actuator pad 18. The tray 40 catches and holds excess ice or water that might be dispensed by the user.

Figure 3:
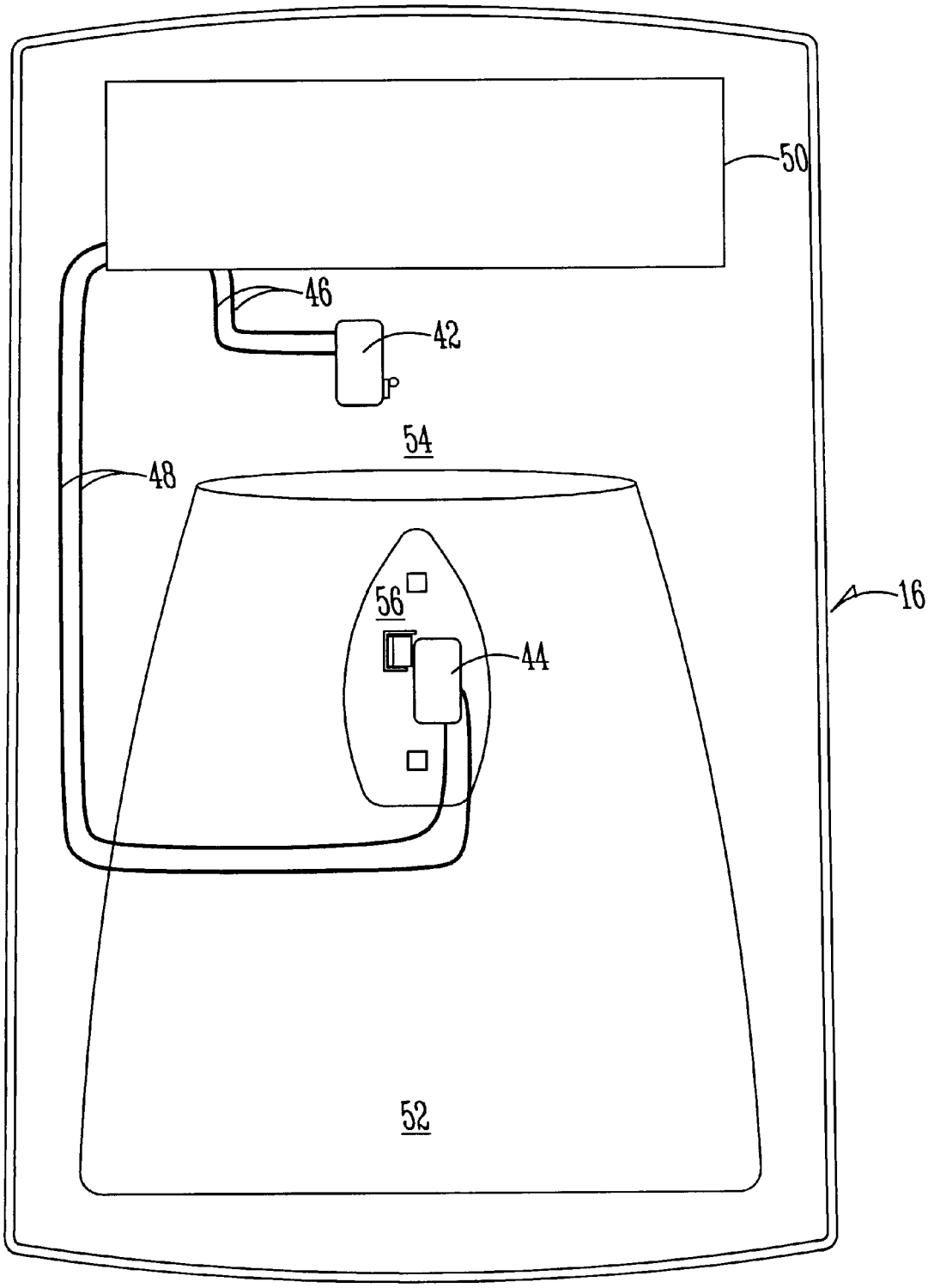
FIG. 3 is a back view of the present invention.

With reference to FIG. 3, the back side of the ice and water dispenser 16 of the present invention is illustrated. On the back side 56 of ice dispenser actuator pad 18 (FIG. 2) is a ice dispenser switch 44. When pressing the ice dispenser actuator pad 18 from the front side (as shown in FIG. 2), the user actually triggers the ice dispenser switch 44. Triggering the ice dispenser switch 44 completes the circuit formed by ice dispenser switch 44, wires 48 and circuit board 50, causing the ice and water dispenser 16 to dispense ice. On the back side 54 of water dispenser lever 20 (FIG. 2) is a water dispenser switch 42. When pressing the water dispenser lever 20 from the front side (as shown in FIG. 2), the user actually triggers the water dispenser switch 42. Triggering the water dispenser switch 42 completes the circuit formed by water dispenser switch 42, wires 46 and circuit board 50, causing the ice and water dispenser 16 to dispense water. A circuit board 50 controls all activity of the ice and water dispenser 16. The control panel 24 (FIG. 2) also is connected to the circuit board 50.

Where as the invention has been shown and described in connection with the preferred embodiments thereof, it will be understood that many modifications, substitutions, and additions may be made which are within the intended broad scope of the following claims. From the foregoing, it can be seen that the present invention accomplishes at least all of the stated objectives.

What is claimed is:

1. A refrigerator including an ice and liquid dispenser, the dispenser comprising:

a housing having a front surface, the housing defining a dispensing cavity having a rear surface;

a liquid dispensing actuator disposed on the front surface; and an ice dispensing actuator disposed on the rear surface wherein the liquid dispensing actuator and the ice dispensing actuator dispense into the cavity.

2. The refrigerator including an ice and liquid dispenser of claim 1 wherein the ice dispenser and the liquid dispenser dispense in a common vertical plane.

3. The refrigerator including an ice and liquid dispenser of claim 1 further comprising:

a water tray on a bottom surface of the cavity.

4. The refrigerator including an ice and liquid dispenser of claim 1 further comprising:

a control panel.

5. A refrigeration unit including a liquid/ice dispenser, the liquid/ice dispenser comprising:

a housing defining a cavity for receiving a container;

a liquid dispensing actuator operatively connected to the housing, wherein the actuation of the liquid dispensing actuator causes liquid to be dispensed into the cavity;

an ice dispensing actuator operatively connected to the housing, wherein the actuation of the ice dispensing actuator causes ice to be dispensed into the cavity;

wherein the liquid and ice may be simultaneously dispensed into the container; and wherein the liquid dispensing actuator and the ice dispensing actuator are located in a substantially common vertical Diane.

6. The refrigeration unit of claim 5 wherein the liquid dispensing actuator is a lever.

7. The refrigeration unit of claim 6 wherein the lever is operatively connected to a switch.

8. The refrigeration unit of claim 5 wherein the ice dispensing actuator is a pad.

9. The refrigeration unit of claim 8 wherein the pad is operatively connected to a switch.

10. A method of dispensing ice and liquid from a refrigeration unit, the method comprising:

inserting a container into a first position in a dispensing cavity;

pressing a liquid dispensing button to receive liquid in the container; and pressing an ice dispensing button located in a substantially common vertical plane with the liquid dispensing button and receiving ice in the container without having to move the container from the first position.

11. The method of dispensing ice and liquid from a refrigeration unit of claim 10 wherein the liquid dispensing button and the ice dispensing button are in a depressed position concurrently.

12. The method of dispensing ice and liquid from a refrigeration unit of claim 10 wherein the container is fully inserted into the dispensing cavity.

* * * * *

UNITED STATES PATENT AND TRADEMARK OFFICE

CERTIFICATE OF CORRECTION

PATENT NO. : 6,651,449 B2
DATED : November 25, 2003
INVENTOR(S) : Heims et al.

It is certified that error appears in the above-identified patent and that said Letters Patent is hereby corrected as shown below:

Column 4,
Line 33, "Diane" should read -- plane --

Signed and Sealed this

Thirteenth Day of January, 2004

JON W. DUDAS
*Acting Director of the United States Patent and Trademark Office*